US008608331B2

(12) United States Patent
Wei et al.

(10) Patent No.: US 8,608,331 B2
(45) Date of Patent: Dec. 17, 2013

(54) BACKLIGHT MODULE

(75) Inventors: Lin Wei, Xiamen (CN); Tu Cheng Yu, Xiamen (CN)

(73) Assignee: TPV Display Technology (Xiamen) Co., Ltd., Xiamen (CN)

( * ) Notice: Subject to any disclaimer, the term of this patent is extended or adjusted under 35 U.S.C. 154(b) by 147 days.

(21) Appl. No.: 13/412,794

(22) Filed: Mar. 6, 2012

(65) Prior Publication Data

US 2013/0050988 A1 Feb. 28, 2013

(30) Foreign Application Priority Data

Aug. 24, 2011 (TW) ..... 100130314 A

(51) Int. Cl.
*G09F 13/04* (2006.01)

(52) U.S. Cl.
USPC ..... 362/97.1; 362/97.3

(58) Field of Classification Search
USPC ..... 362/97.1, 97.3
See application file for complete search history.

(56) References Cited

U.S. PATENT DOCUMENTS 7,762,708 B2 * 7/2010 Lee et al. ..... 362/632
2011/0176292 A1 * 7/2011 Lee ..... 362/97.1

* cited by examiner

*Primary Examiner* — Evan Dzierzynski
(74) *Attorney, Agent, or Firm* — Harrington & Smith

(57) ABSTRACT

A backlight module includes a first optical film with high light reflection characteristics, a second optical film with polarization light selection transmission characteristics and light reflection characteristics, a plurality of lampshades, and a plurality of line light sources. Each lampshade has high light reflection characteristics and is disposed between optical films so that any two spaced-apart adjacent lampshades define a light mixing chamber between optical films. Each line light source is disposed in a corresponding light mixing chamber and is mounted to a corresponding lampshade for emitting light.

11 Claims, 4 Drawing Sheets

BACKLIGHT MODULE

CROSS-REFERENCE TO RELATED APPLICATION

This application claims priority to Taiwanese Application No. 100130314, filed on Aug. 24, 2011.

BACKGROUND OF THE INVENTION

1. Field of the Invention

The invention relates to a backlight module, and more particularly to a backlight module using line light sources.

2. Description of the Related Art

Recently, displays are to satisfy requirements for lower power consumption, slim style, high image quality, and no-radiation. Accordingly, the Thin Film Transistor Liquid Crystal Display (TFT-LCD) has become the main stream in the current market. The TFT-LCD is a non-active light-emitting display. The TFT-LCD mainly consists of a liquid crystal display panel, and a backlight module providing a stable lighting source.

The backlight modules can be designed to have a uniform surface light intensity using arrangement of light-emitting components and selection of optical materials. Typically, there are two types of backlight modules: an edge-lighting type and a direct-lighting type. The direct-lighting type backlight module can provide a surface source with higher brightness on a unit area, but it needs a light mixing space with a specific height, which is not conducive to slim-style design. According to the requirements, the edge-lighting backlight module is adopted to meet requirements for slim-style products.

Referring to FIG. 1, a conventional edge-lighting backlight module 1 is shown to include a light guiding plate 11, two light sources 12 disposed respectively on opposite lateral sides of the light guiding plate 11, and an optical element 13 disposed on the light guiding plate 11.

Light emitted by the light source 12, such as line light or point light, can be guided and mixed by the light guiding plate 11, and is then radiated out from a light exit surface 111 of the light guiding plate 11 in the form of surface light. The optical element 13 is disposed on the light exit surface 111 of the light guiding plate 11. Generally, the optical element 13 is a diffuser film to diffuse light and eliminate partly dark areas and further to converge and condense light so as to improve the light guiding effect of the conventional edge-lighting backlight module 1 when incorporating a brightening film.

When the conventional backlight module is applied to a large-size display panel, the following are some drawbacks of the conventional backlight module 1:

1. The light guiding plate 11 with a large size and high quality has a higher cost.
2. The large-size light guiding plate 11 easily deforms because of its heavy weight.
3. The large-size light guiding plate 11 easily becomes yellow and is deteriorated by environmental influences.

SUMMARY OF THE INVENTION

Therefore, an object of the present invention is to provide a backlight module using line light sources that can overcome the aforesaid drawbacks of the prior art.

Accordingly, a backlight module of this invention comprises a first optical film, a second optical film, a plurality of lampshades, and a plurality of line light sources.

The first optical film has high light reflection characteristics.

The second optical film is spaced apart from the first optical film, and has polarization light selection transmission characteristics and light reflection characteristics.

The lampshades have high light reflection characteristics, and are disposed between the first optical film and the second optical film. The lampshades extend in an axial direction, and are arranged so that any two spaced-apart adjacent ones of the lampshades cooperate with the first and second optical films to define a light mixing chamber thereamong, thereby forming a plurality of the light mixing chambers between the first and second optical films.

Each of the line light sources is disposed in a corresponding one of the light mixing chambers, extends in the axial direction, and is mounted to a corresponding one of the lampshades for emitting light. Light emitted by each of the line light sources is mixed in the corresponding one of the light mixing chambers through reflection by two corresponding spaced-apart ones of the lampshades defining the corresponding one of the light mixing chambers such that light transmitted out from the corresponding one of the light mixing chambers through the second optical film forms a surface light field.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENT

Figure 1:
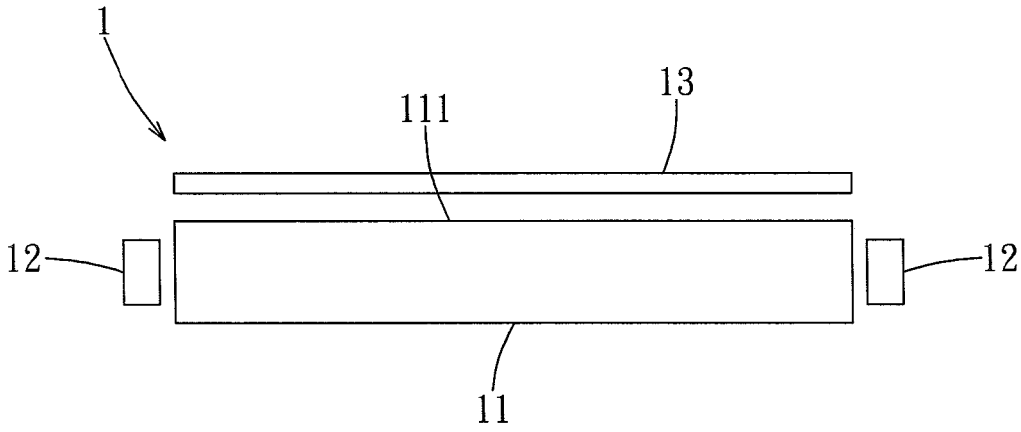
FIG. 1 PRIOR ART
FIG. 1 is a schematic view showing a conventional edge-lighting type backlight module.

Before the present invention is described in greater detail, it should be noted that like elements are denoted by the same reference numerals throughout the disclosure.

Figure 2:
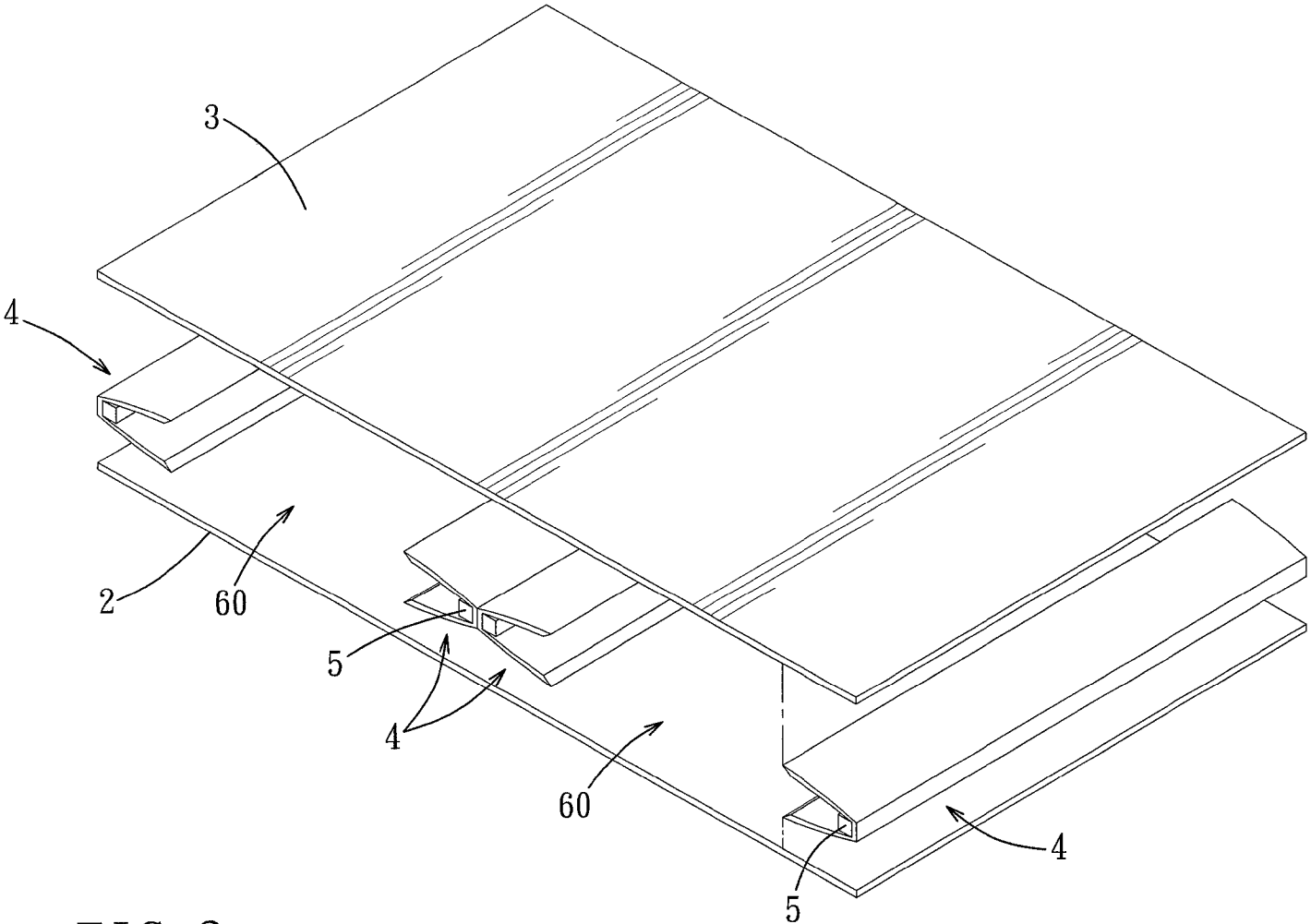
FIG. 2 is a partly exploded perspective view showing the first preferred embodiment of a backlight module according to the present invention.
Figure 3:
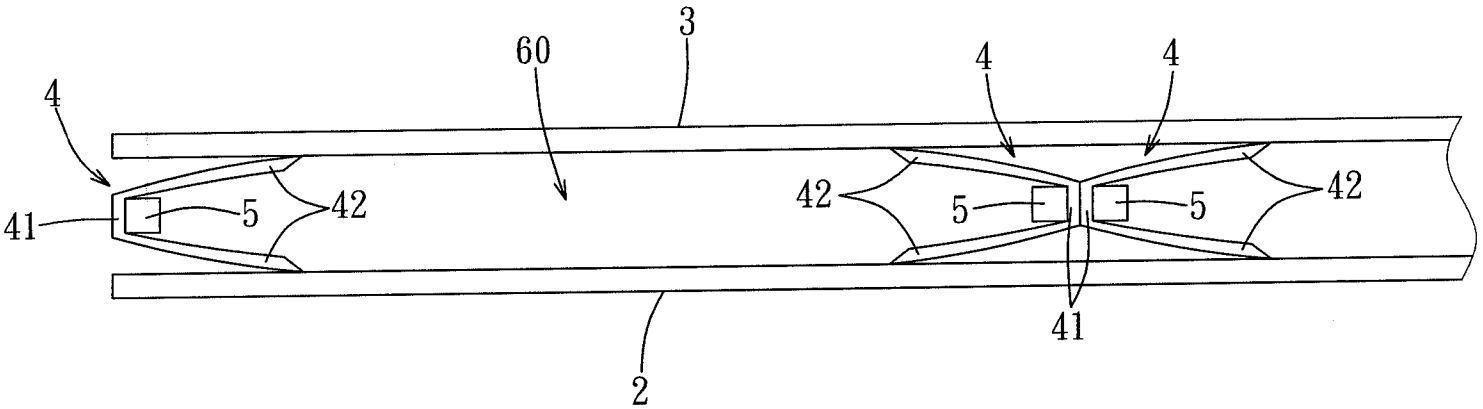
FIG. 3 is a fragmentary schematic side view showing the first preferred embodiment.

Referring to FIGS. 2 and 3, the first preferred embodiment of a backlight module of the present invention is shown to include a first optical film 2, a second optical film 3, a plurality of lampshades 4, and a plurality of line light sources 5.

The first optical film 2 has high light reflection characteristics. In this embodiment, the first optical film 2 is in the form of a silver reflection sheet or a white reflection sheet. The first optical film 2 has a light reflection rate greater than 80%.

The second optical film 3 is spaced apart from and parallel to the first optical film 2. The second optical film 3 has polarization light selection transmission characteristics and light reflection characteristics. The second optical film 3 is in the form of a sheet or a plate. Preferably, the second optical film 3 has a light transmission rate ranging from 15% to 95% and a light reflection rate ranging from 15% to 95%.

The lampshades 4, extending in an axial direction, have high light reflection characteristics and are disposed between the first optical film 2 and the second optical film 3. Any two spaced-apart adjacent ones of the lampshades 4 cooperate with the first optical film 2 and the second optical film 3 to define a light mixing chamber 60 thereamong, thereby forming a plurality of the light mixing chambers 60 between the first and second optical films 2, 3.

In this embodiment, four lampshades 4 are used such that two light mixing chambers 60 are formed, but the backlight module is not limited in this respect. Each of the lampshades 4 includes an elongate base wall 41 extending in the axial direction and two extending walls 42. The elongate base wall 41 has two opposite sides. The two extending walls 42 extend respectively from the two opposite sides of the base wall 41 and toward a corresponding spaced-apart adjacent one of the lampshades 4. Further, the extending walls 42 of each of the lampshades 4 abut respectively against the first optical film 2 and the second optical film 3 such that the lampshades 4 can support the first optical film 2 and the second optical film 3 to avoid deformation from gravity and stress. For each lampshade 4, an angle formed between the base wall 41 and any one of the extending walls 42 is not less than 90° but less than 180°. The angle is determined based on the requirements of the product. Basically, the larger the light mixing chamber 60, the larger will be the angle to obtain uniform light intensity and sufficient brightness.

In consideration of the uniform light transmission of the backlight module, each of the lampshades 4 is required to have a certain light transmission rate and a relatively high light reflection rate, both ranging from 5% to 95%. Each of the lampshades 4 is made from a material selected from the group consisting of polymethylmethacrylate (PMMA), polycarbonate (PC), polystyrene (PS), polyethylene terephthalate (PET), other high polymer compounds, etc., to have the desired light transmission rate and light reflection rate. The lampshades 4 can be integrally made by extrusion molding, injection molding, or polymer molding to reduce the fabrication costs.

Each of the line light sources 5 is disposed in a corresponding one of the light mixing chambers 60, extends in the axial direction, and is mounted to the base wall 41 of a corresponding one of the lampshades 4 for emitting light. In this embodiment, each of the line light sources 5 includes one of a cold cathode fluorescent lamp (CCFL) and a light-emitting diode (LED).

Light emitted by each of the line light sources 5 is mixed in the corresponding one of the light mixing chambers 60 through reflection by two corresponding spaced-apart ones of the lampshades 4 defining the corresponding one of the light mixing chambers 60 such that light transmitted out from the corresponding one of the light mixing chambers 60 through the second optical film 3 forms a surface light field. Due to the plurality of the light mixing chambers 60, the backlight module of the present invention can achieve superior light mixing effect and avoid generation of uneven light.

More specifically, the light emitted by each line light source 5 is reflected by the first optical film 2 and the second optical film 3 to achieve light guiding and mixing effects, thereby forming the surface light field. Besides, since the lampshades 4 have the relatively high light reflection rate, most of the light emitted by each line light source 5 is retained in the corresponding light mixing chamber 60 through the two corresponding lampshades 4, thereby enhancing light utilization efficiency. Since each line light source 5 is so close to the corresponding lampshade 4, the light within the corresponding lampshade 4 has the greatest light intensity. With the certain light transmission rate of the lampshades 4, the light transmitted from each lampshade 4 has brightness close to that in the light mixing chamber 60, thereby achieving the light uniformity of the surface light field.

Figure 4:
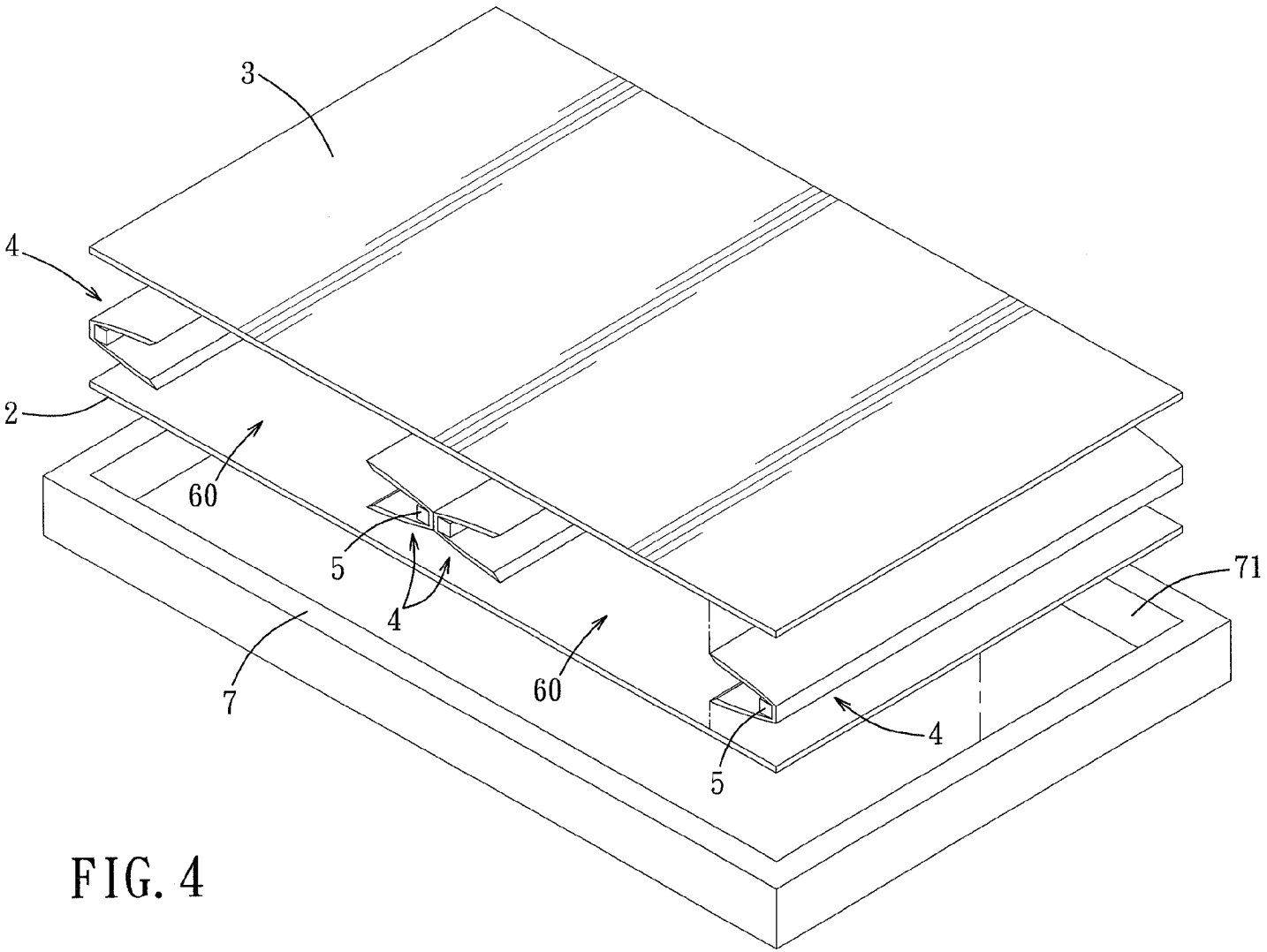
FIG. 4 is a partly exploded perspective view showing the second preferred embodiment of a backlight module according to the present invention.

FIG. 4 illustrates the second preferred embodiment of a backlight module according to the present invention, which is a modification of the first preferred embodiment. Unlike the previous embodiment, the backlight module further includes a frame body 7 surrounding the first and second optical films 2, 3. In this embodiment, the frame body 7 cooperates the first and second optical films 2, 3, and the lampshades 4 to form a stable supporting structure that can support additional optical lenses (not shown) on the backlight module.

Preferably, the frame body 7 has an inner surrounding surface 71 with a light reflection rate greater than 80%. With the inner surrounding surface 71 around the backlight module, leaking light reflected by the lampshades 4 and out of the light mixing chambers 60 is reflected by the inner surrounding surface 71 of the frame body 7 back to the light mixing chambers 60, thereby enhancing light utilization efficiency.

It is evident from the foregoing that the backlight module of the present invention uses the first optical film 2, the second optical film 3, the spaced-apart adjacent lampshades 4 with the high reflection characteristics and the lower light transmission characteristics, and a plurality of the line light sources 5 that can further improve the light uniformity and light utilization efficiency. Moreover, due to the presence of the frame body 7, the backlight module of the present invention has a stable supporting structure suitable for a display panel with a large size without deformation. Therefore, the backlight module of the present invention not only has the slim-style benefits of the conventional edge-lighting backlight modules, but also has a better light mixing effect comparable to that of the direct-lighting backlight modules. Moreover, the backlight module of the present invention can be applied to a display panel with a large size.

While the present invention has been described in connection with what are considered the most practical and preferred embodiments, it is understood that this invention is not limited to the disclosed embodiments but is intended to cover various arrangements included within the spirit and scope of the broadest interpretation so as to encompass all such modifications and equivalent arrangements.

What is claimed is:

1. A backlight module comprising:

a first optical film having high light reflection characteristics;

a second optical film spaced apart from said first optical film, and having polarization light selection transmission characteristics and light reflection characteristics;

a plurality of lampshades having high light reflection characteristics, disposed between said first optical film and said second optical film, extending in an axial direction, and arranged so that any two spaced-apart adjacent ones of said lampshades cooperate with said first and second optical films to define a light mixing chamber thereamong, thereby forming a plurality of said light mixing chambers between said first and second optical films; and a plurality of line light sources each disposed in a corresponding one of said light mixing chambers, extending in the axial direction and mounted to a corresponding one of said lampshades for emitting light;

wherein light emitted by each of said line light sources is mixed in the corresponding one of said light mixing chambers through reflection by two corresponding spaced-apart ones of said lampshades defining the corresponding one of said light mixing chambers such that light transmitted out from the corresponding one of said light mixing chambers through said second optical film forms a surface light field.

2. The backlight module as claimed in claim 1, wherein each of said lampshades includes an elongate base wall extending in the axial direction, mounted with a corresponding one of said line light sources thereon and having opposite sides, and two extending walls extending respectively from said opposite sides of said base wall and toward a corresponding spaced-apart adjacent one of said lampshades.

3. The backlight module as claimed in claim 2, wherein said extending walls of each of said lampshades abut respectively against said first and second optical films.

4. The backlight module as claimed in claim 2, wherein, for each of said lampshades, an angle formed between said base wall and any one of said extending walls is not less than 90° but less than 180°.

5. The backlight module as claimed in claim 1, wherein each of said lampshades has a light reflection rate ranging from 5% to 95%.

6. The backlight module as claimed in claim 1, wherein each of said lampshades is made from a material selected from the group consisting of polymethylmethacrylate (PMMA), polycarbonate (PC), polystyrene (PS), and polyethylene terephthalate (PET).

7. The backlight module as claimed in claim 1, wherein said first optical film has a light reflection rate greater than 80%.

8. The backlight module as claimed in claim 1, wherein said second optical film has a light transmission rate ranging from 15% to 95%, and a light reflection rate ranging from 15% to 95%.

9. The backlight module as claimed in claim 1, wherein each of said line light sources includes one of a cold cathode fluorescent (CCFL) and a light-emitting diode (LED).

10. The backlight module as claimed in claim 1, further comprising a frame body surrounding said first and second optical films.

11. The backlight module as claimed in claim 10, wherein said frame body has an inner surrounding surface with a light reflection rate greater than 80%.

* * * * *